United States Patent [19]

Lindner

[11] 3,942,685

[45] Mar. 9, 1976

[54] DISPENSER ASSEMBLY

[75] Inventor: Marvin T. Lindner, West Chicago, Ill.

[73] Assignee: Eaton Corporation, Cleveland, Ohio

[22] Filed: June 12, 1974

[21] Appl. No.: 478,569

[52] U.S. Cl. ..... 222/129.1; 222/144.5; 222/145; 222/146 C

[51] Int. Cl.[2] ..... B67D 5/56

[58] Field of Search..... 222/129.3, 129.2, 129.1, 222/134, 144.5, 145, 132, 146 C

[56] References Cited

UNITED STATES PATENTS

| | | | |
|---|---|---|---|
| 2,823,833 | 2/1958 | Bauerlein | 222/129.2 |
| 3,144,967 | 8/1964 | McClain | 222/144.5 |
| 3,396,871 | 8/1968 | McCann | 222/144.5 X |
| 3,756,473 | 9/1973 | Donahue | 222/129.2 |

*Primary Examiner*—Allen N. Knowles
*Attorney, Agent, or Firm*—Teagno & Toddy

[57] ABSTRACT

A dispenser assembly for dispensing a plurality of beverages and which includes a support housing for mounting in a refrigerator. The housing includes upper and lower sections therein, and a removable front cover to enable access to the interior thereof. A keyboard-like selector valve assembly is removably mounted in the upper section being connected to a source of mixing beverage by a remote mounted inlet valve. A plurality of containers are mounted in the lower section, each storing a drink concentrate therein. A mixing section connects the containers to the selector valve assembly for mixing the drink concentrate with the mixing beverage. The selector valve assembly includes a plurality of selector keys mounted in juxtaposed relation to one another each having one end accessible through the cover for quick and easy identification and selection of a beverage. The mixing section includes nozzle means for securing the mixing section to the selective valve assembly and through which the selected beverages are dispensed. Each container is detachably connected to the mixing section at one end and pivotally supported on an inclined ramp at the other end to enable the container to be slid into and out of the housing and pivoted into and out of connection with the mixing section in a manner to reduce spillage of the concentrate therein.

8 Claims, 6 Drawing Figures

DISPENSER ASSEMBLY

BACKGROUND OF THE INVENTION

The present invention relates to dispensing assemblies, and more particularly, to a dispensing assembly arranged for quick and easy identification and selection of one of a plurality of beverages, and still more particularly, to a dispensing assembly which is arranged for quick disassembly for cleaning and maintenance for the dispensing of beverages in a highly sanitary and efficient manner.

Several known types of dispenser assemblies have been utilized in refrigerators to dispense either water or a mixture of water and a drink concentrate therefrom. One of these known dispenser assemblies is disclosed in U.S. Pat. No. 3,756,473 issued Sept. 4, 1973 to William R. Donahue, Jr. While these known dispenser assemblies have been generally satisfactory in operation, certain problems have been encountered in both operating and manufacturing them.

For example, the operation of one of such known drink dispensers is considered somewhat unsatisfactory in that identification and beverage selection has been somewhat complicated, or at least is not considered to be as easy or simple as desired. In addition, difficulties have been encountered due to leaking and dripping of the water and/or mixed beverages from the dispenser due to excessive pressure buildup within the dispenser or backing up of the beverages in the dispenser after shut off. Mounting problems have also been encountered due to the bulky construction of many known drink dispensers which prevents them from being located at certain desirable positions within a refrigerator. Another problem which has been encountered has been excessive evaporation of the concentrate, as well as, odor transfer between the concentrate and other items in the refrigerator. Finally, many of the known dispensers have been relatively difficult to assemble and disassemble so as to make repair and maintenance cumbersome and time consuming.

SUMMARY OF THE INVENTION

The present invention contemplates providing an improved dispenser assembly which can be operated in a highly efficient and sanitary manner as compared to known dispensers and particularly as compared to a dispenser of the type described in U.S. Pat. No. 3,756,473 issued Sept. 4, 1973.

The dispenser assembly of the present invention includes a support housing which is adapted for mounting in a refrigerator. The housing includes a removable front cover to provide access to the interior thereof, and has an interior support shelf which defines an upper section and a lower section. A selector valve means is slidably mounted on the shelf in the upper section for easy assembly and disassembly, being operably connected to a mixing beverage source, such as a reservoir of water, for controlling the flow of the water through the dispenser assembly. The selector valve means includes a plurality of distributing valve assemblies, each having a closed position to prevent water flow therethrough and an open position permitting water flow through its outlet. A nozzle means is connected to the distributing valve assemblies for dispensing the beverages. The selector valve means further includes a plurality of laterally extending selector keys disposed in juxtaposed relation for easy beverage identification and selection. The keys are supported for pivotal movement in generally parallel planes, each having one end operably connected to a respective one of the valve assemblies for moving the latter between its closed and open position to permit water to flow to the nozzle means for dispensing therefrom. Container means is mounted in the lower section for storing a drink concentrate therein, and a mixing means is connected between the container means and the outlet of at least one of the valve assemblies for mixing a concentrate with water. The container means includes at least one container having one end adapted for detachable connection to the mixing means, and the housing includes a ramp means below the mixing means to enable the container to be slidably guided into the housing into aligned relation with the mixing means for connection thereto. The opposite end of the container is pivotally supported by the ramp means to enable the one end of the container to be raised from the ramp means into its connected position and lowered onto the ramp means upon disconnection thereof to reduce the possibility of spillage of the concentrate from the container during installation and remove thereof. The selector valve means further includes inlet valve means having a main inlet valve for controlling the flow of water from the reservoir. The inlet valve comprises a solenoid-actuated valve mounted in the refrigerator at a location remote from the housing, and a common operating lever is mounted in the housing for camming engagement with one end of the respective keys for actuating the inlet valve to permit water to flow to the distributing valve assemblies. A switch assembly is mounted on the housing, being separated from the valve assemblies, and thus, from the associated plumbing thereof. Still further, the selector valve means includes a body, and the mixing means is mounted on the body. The mixing means includes a frame having an opening therein and the body includes an outwardly projecting conduit which is connected in fluid communication at one end to another one of the valve assemblies. The conduit extends through the opening in the frame, having its outer end projecting beyond the frame when the mixing means is in the mounted position on the body. The nozzle means includes one nozzle which is detachably and interlockingly connected to the outer end of the conduit to secure the mixing means in a mounted position on the body. A drip tray is detachably connected to the housing below the nozzle means, being detachable independently of the front cover. The drip tray is of a double trough construction, having an inner trough for receiving any beverage dripping outwardly of the front cover from the nozzle means and an inner trough for receiving any beverage dripping inwardly of the cover, such as from the mixing means. As can be seen, the foregoing arrangement provides a dispenser assembly which is extremely compact providing great versatility for mounting within a refrigerator. In addition, the assembly is arranged for quick, simple beverage identification and selection, as well as quick, and easy assembly and disassembly for maintenance and cleaning thereof. Still further, the dispenser assembly is arranged to minimize concentrate evaporation, odor transfer, spillage and dripping resulting in a highly sanitary installation.

DESCRIPTION OF THE PREFERRED EMBODIMENTS

Figure 1:
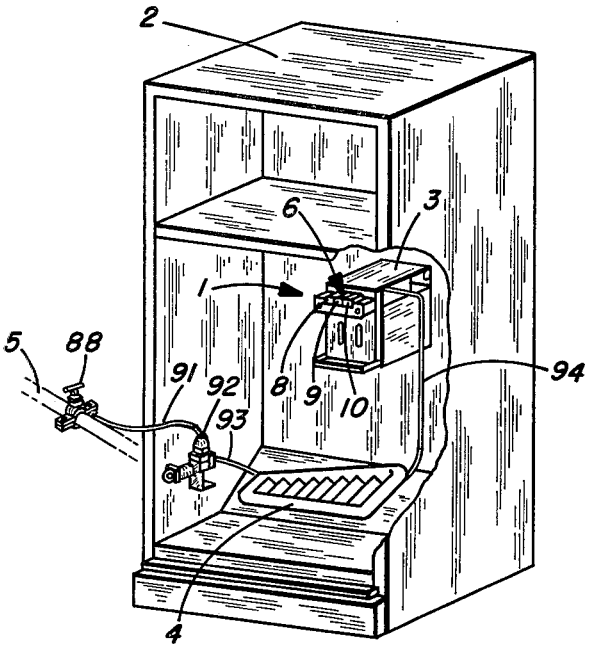
FIG. 1 is a perspective view of the dispenser assembly of the present invention shown mounted in a refrigerator.
Figure 2:
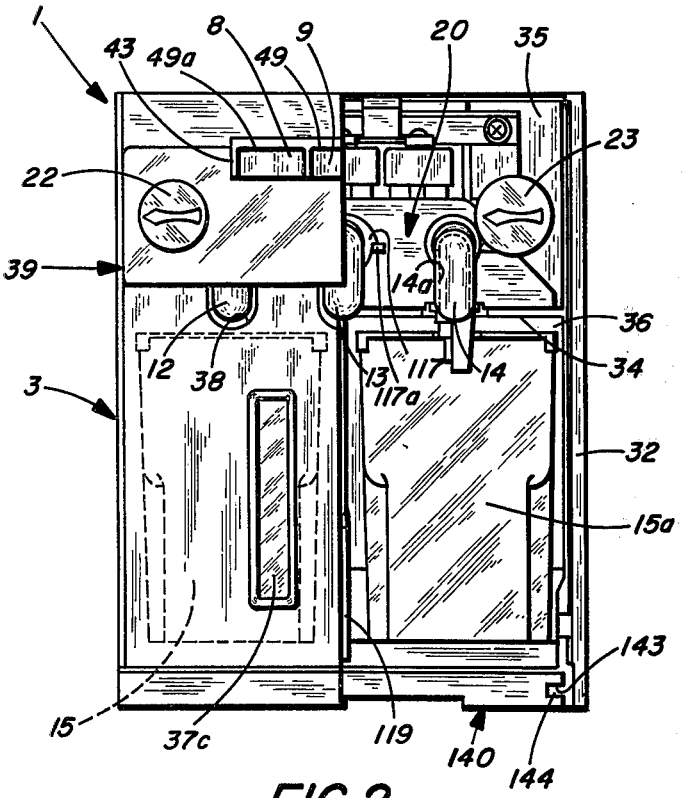
FIG. 2 is a partially cut-away, front elevation view of the dispenser assembly of the present invention shown in FIG. 1.

Referring now again to FIG. 1, the drink dispenser assembly of the present invention is illustrated, generally at 1, in FIG. 1, and is shown mounted in a refrigerator 2 in association with a mixing beverage reservoir or tempering tank 4 for storing a mixing beverage, such as water or the like, which is supplied from a water line 5. The dispenser assembly 1 includes a housing 3 which supports a keyboard-like selector valve assembly 6 having a plurality of selector keys 8, 9 and 10, which are operable between an unactuated or non-dispensing position and an actuated or dispensing position for dispensing only cold water or a combination of cold water and a drink concentrate. More particularly, the key 9 is operable to dispense only cold water through a nozzle 13, whereas, the keys 8 and 10 are operable to dispense a selected one of a plurality of drinking concentrates such as two through nozzles 12 and 14 (FIG. 2). The drink concentrates are stored in separate containers 15 and 15*a* disposed within the housing 3. The assembly 1 further includes a mixing section 20 FIGS. 2 and 3) which is adapted to mix the drink concentrates with the water for dispensing through the nozzles 12 and 14. Control knobs 22 and 23 are operably connected to the mixing section 20 for controlling the strength of the mixed drinks being dispensed.

Figure 3:
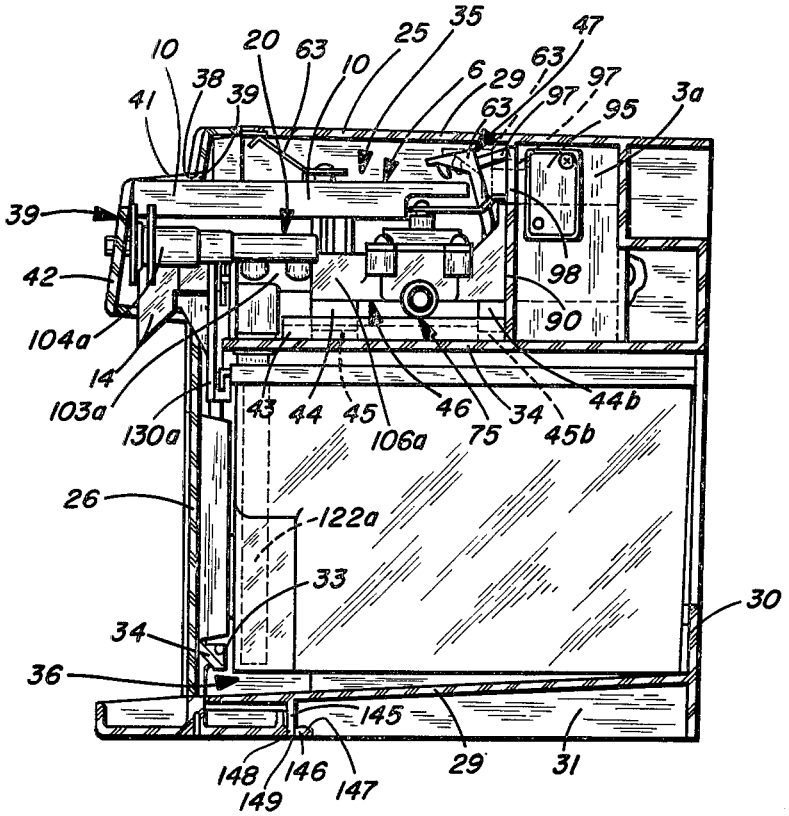
FIG. 3 is a side elevation view of the dispenser assembly of the present invention as seen from the right side of FIG. 2.
Figure 6:
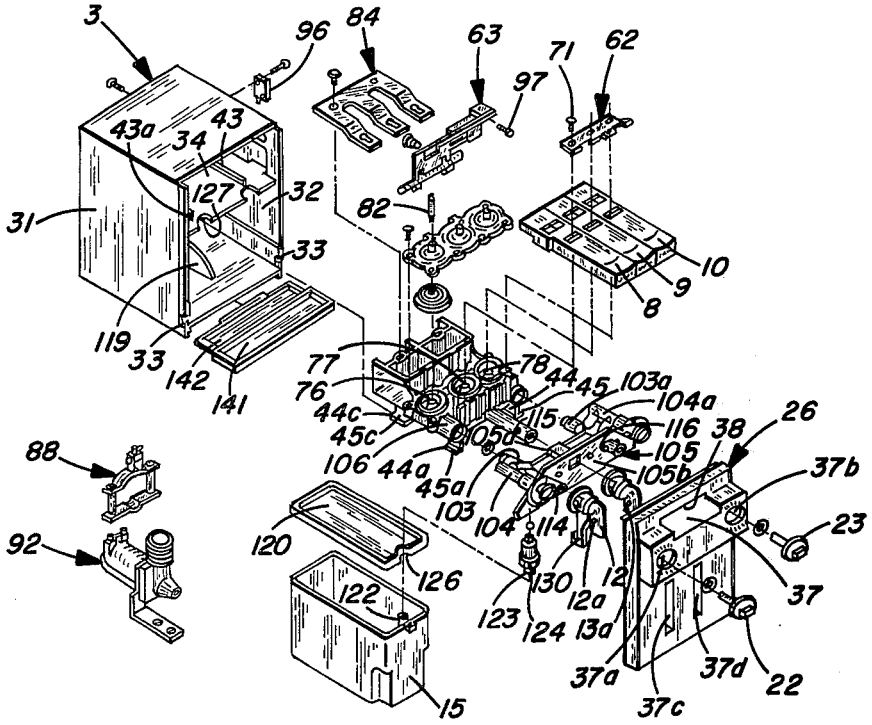
FIG. 6 is an assembly view of the dispenser assembly of the present invention shown in FIG. 1.

Referring now to FIGS. 2, 3 and 6, the housing 3 is shown as having a removable front wall or cover 26 to enable access to its interior. In the form shown, the housing 3 is of a box-like construction including a top wall 28, a bottom wall 29, and rear wall 30 (FIG. 2) which extend between are are made integral with opposed sidewalls 31 and 32 (FIG. 6). The houring 3 further includes an interior or upper support shelf 34, which is supported between the sidewalls 31 and 32 and divides the housing 16 into an upper section 35 and a lower section 36 as best seen in FIG. 3.

The cover 26 is formed with rearwardly extending peripheral flange 25 which extends rearwardly along the upper and side edges thereof for fitted engagement about deformable forwardly extending flanges 27 which extend downwardly along the forward edges of the sidewalls 31 and 32. The flanges 27 are notched, as at 33, (FIG. 6), being adapted to interlockingly receive projections, only one shown at 34 in FIG. 3, formed on the inside of the cover flange 25. As shown in FIG. 3, the cover 26 is provided with an opening 37 near its upper end, which is defined along its upper side by marginal edge 38, and through which the nozzles, such as 14, extend so as to be disposed outwardly of the cover 26. A downwardly opening hood 39 covers the opening 37, and thus the nozzles, and includes a generally horizontally extending roof portion 41 which is formed integrally with a downwardly depending outer wall portion 42 which is inclined downwardly and forwardly at a slight angle with respect to the general plane of the front wall 26. As further shown in FIG. 3, another opening 42 is formed in the hood 39 which extends from the front wall 26 forwardly across the roof wall portion 41 and partially down the outer wall portion 42 to provide access to one end, such as the outer end of the keys 8, 9 and 10, to enable actuation thereof. In addition, openings 37*a* and 37*b* (FIG. 6) are formed in the outer wall portion of the hood 39 through which access may be had to control knobs 22 and 23, thus enabling complete control of the dispenser assembly from the exterior of the housing 3. Elongated windows in the form of slots 37*a* and 37*d* are also formed in the cover 26 being offset from the center so that the level of the liquid concentrate in the containers may be observed, and thus visually indicated when refilling is necessary without necessitating the removal of the cover 26.

Figure 4:
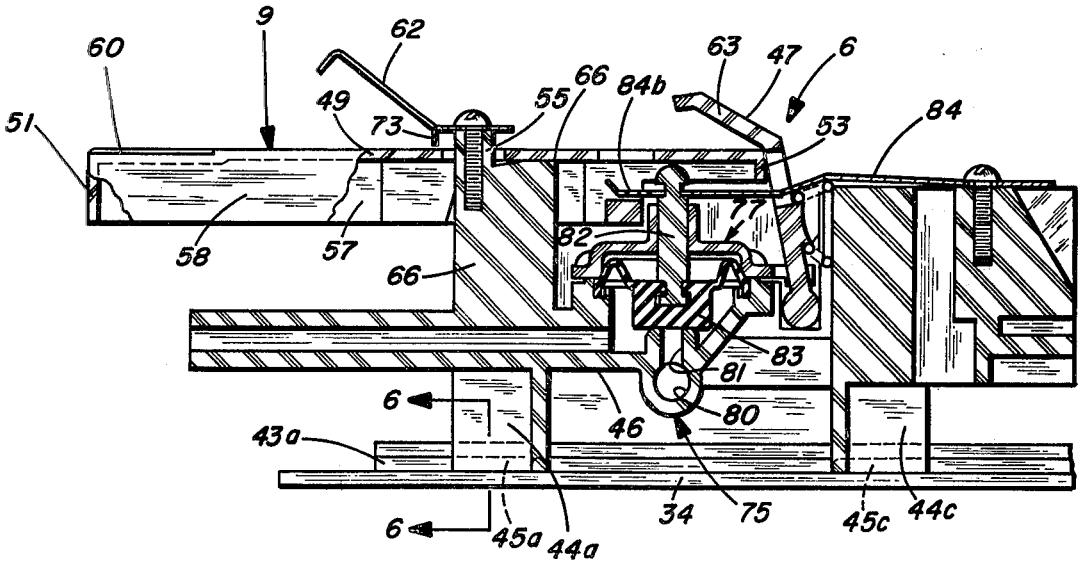
FIG. 4 is a transverse sectional view taken along the lines 4—4 of FIG. 5.
Figure 5:
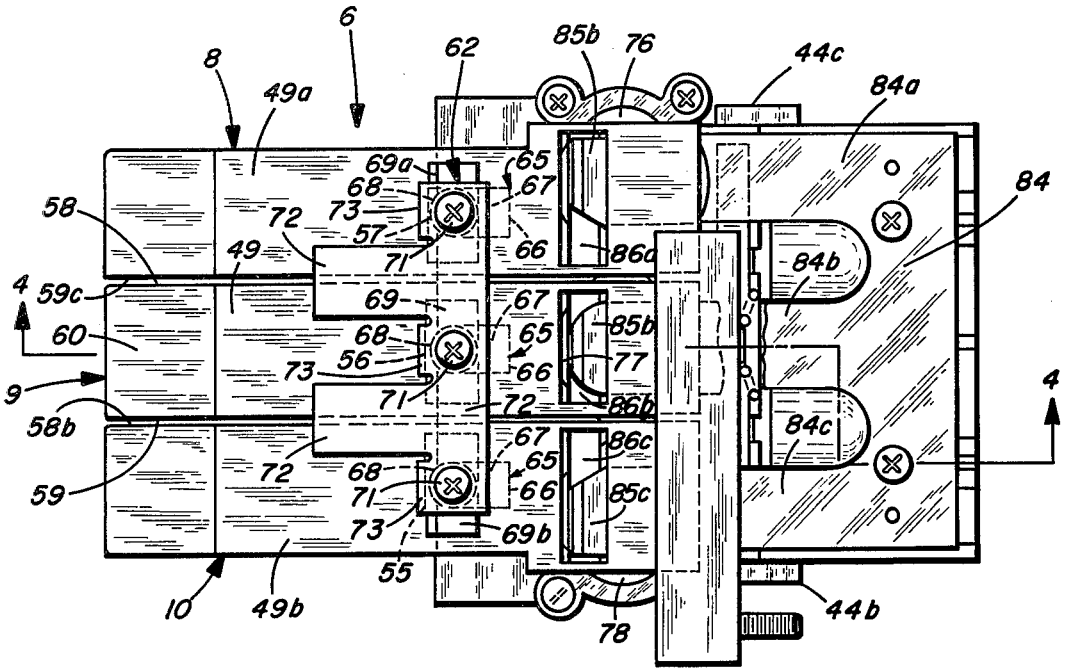
FIG. 5 is a top plan view of the selector valve assembly of the present invention shown in its disassembled condition.

Referring now to FIG. 4, the selector valve assembly 6 is removably mounted on the upper shelf 34 in the upper section 35. As shown, the assembly 6 includes a support body 46 which pivotally supports the keys 8, 9 and 10 for movement in generally parallel, vertical planes, as will be described more fully hereinafter. As shown in FIGS. 3, 4 and 6, the support body 46 has a set of downwardly depending legs including a front pair 44 and 44*a* (FIG. 6), and a rear pair 44*b* and 44*c* (FIGS. 5 and 6). As shown in FIG. 6, each of the legs includes outwardly extending flanges or feet 45, 45*a*, 45*b* and 45*c* (FIGS. 3, 4 and 6), which are adapted for sliding interlocking engagement with spaced, laterally extended slide rails 43 and 43*a* (FIGS. 3, 4 and 6) which are secured to the upper shelf 34, and which extend from the front to the rear of the housing 3. More particularly, the slide rails 43 and 43*a* include oppositely disposed, inwardly projecting flanges which are spaced above the shelf 34, under which the feet 45, etc., are slidably received when the selector assembly 6 is in the mounted position within the housing, as best seen in FIGS. 3 and 4, for guiding the body 46 into position in the housing 3.

Referring now again to FIGS. 3 and 4, the keys, such as 10, (FIG. 3), are supported in the housing 15 in a generally horizontal, non-actuated position having their outer ends extending into the hood 39 just below the marginal edge 38 to enable access thereto through the opening 37. The opposite, or inner, end of the key 10 (FIG. 3) is disposed for operable engagement with an inlet valve assembly 47 as will be described more fully hereinafter.

As the keys 8, 9 and 10 are of a generally similar construction, only one such as 9, will be described in detail, and like parts of the other keys 8 and 10 will be designated by like numerals having a suffix *a* and *b* added thereto, respectively, when necessary. Referring now to FIGS. 4 and 5, the key 9 is of a hollow construction and has a generally oblong configuration. The key 9 is open at the bottom and is defined by a top wall 49, generally parallel front wall 51 and rear wall 53, all of which extend between and are formed integral with downwardly depending, generally parallel sidewalls 57 and 58. The top wall 49 includes a slightly arcuate depression 60 adjacent the outer end of the key 9 providing an actuating area for contact with the finger tip of an operator.

As seen best in FIG. 5, the keys 8, 9 and 10 are mounted in laterally extending, juxtaposed relation having their sidewalls disposed in generally parallel relation to one another. More particularly, the sidewalls 58 and 59 of the key 9 are disposed in confronting, close proximity to the sidewalls 59 and 58*b* of the adjacent keys 8 and 10, respectively. The spacing between the confronting sidewalls, such as sidewall 58 of key 9, and sidewall 59*a* of the key 8 is considerably less than the widthwise dimension of the respective keys. In addition, and as best seen in FIG. 2, the top walls 49, 49*a* and 49*b* of the keys are disposed in generally parallel, coplanar relation when the assembly 6 is in the assembled condition, and thus, forms a keyboard-like construction which provides quick and easy beverage identification and selection of a desired beverage due to the close aligned grouping of the keys.

Referring now to FIGS. 4 and 5, the keys, such as 9, are maintained in their horizontal non-actuated position on the support body 46 by a resilient holding element 62 and a common operating lever 63 which forms part of the inlet valve assembly 47. As shown, the support body 46 includes a plurality of support posts as at 65, each of which supports a respective one of the keys 8, 9 and 10 thereon. More particularly, each post 65 includes a fulcrum support 66 which pivotally engages the underside of the top walls 49*a* and 49*b*. In the form shown, the fulcrum supports 66 are each formed by an inclined surface 67 which is inclined forwardly and downwardly, and which terminates in an upwardly extending projection 68. Each of the keys 8, 9 and 10 includes an opening, such as at 69*a*, 69 and 69*b*, respectively, in its top wall between its inner and outer end through which an associated projection 68 extends for attachment to the holding element 62. As shown in FIG. 5, the holding element 62 includes a base portion 70 which is attached to the respective post 65 by screws, as at 71. The holding element 62 further includes a pair of spaced, upwardly extending fingers 72 which are adapted to engage the top wall 29 and apply a downward pressure to the support body 46 when it is in the installed position. Downwardly depending abutment tabs 73 are disposed between the fingers 72 in overlying relation with respect to each key 8, 9 and 10, for abutting engagement with the top walls 49, 49*a* and 49*b* of the keys 8, 9 and 10 to limit their upward movement and maintain them in parallel aligned relation when pressure is applied at their inner ends by the common operating levers 63 when the assembly 6 is in the installed position, as will be discussed hereinafter.

As shown in FIG. 4, the inlet valve assembly 47 includes manifold means 75 having a plurality, such as three distributing valve assemblies 76, 77 and 78 (FIG. 6) which are actuated by the keys 8, 9 and 10, respectively (FIG. 5). The valve assemblies 76, 77 and 78 are of similar construction to the distributing valve assemblies described in the aforementioned U.S. Pat. No. 3,756,473, and thus, will not be described in substantial detail herein, except that each valve assembly, such as 77 (FIG. 4) is connected in fluid communication to a common manifold passage 80 by an inlet passage 81 (FIG. 4). Each includes an actuating pin 82 which is connected to a diaphragm 83 for opening and closing the inlet passage 81. A leaf spring 84 is mounted on the support body 46 having three forwardly extending resilient leaves 84*a*, 84*b* and 84*c* which are connected to an associated one of the pins 82 of the valve assemblies 76, 77 and 78, being adapted to be lifted by the keys 8, 9 and 10, respectively, to open the valve inlets 81 and permit the flow of water therethrough. More particularly, the leaves 84*a*, 84*b* and 84*c* include actuating tip portions 85*a*, 85*b* and 85*c* which extend forwardly of the pins 82 and overlie actuating bars 86*a*, 86 and 86*b* which are formed integral with and extend transversely between the sidewalls of the keys 8, 9 and 10, respectively. The actuating tip portions 85*a*, 85*b*, and 85*c* are disposed in sufficiently close proximity to the actuating bars 86*a*, 86 and 86*b*, respectively, such that upon pivotal movement of the keys 8, 9 and 10, in a counterclockwise direction, as best seen with regard to key 9 in FIG. 4, the associated actuation bar, such as 86, will cammingly engage the actuating tip portion, such as 85*b*, to lift the leaf 84*b* and raise the associated pin 82 to open the valve assembly 77. The levers 8 and 10 operate in a similar manner to open the valves 76 and 78.

As also seen in FIG. 4, the common operating lever 63 is supported at its lower edge, as at 87, for pivtal movement on the support body 46. A coil spring 89 is mounted between the lever 63, and an upstanding backwall 90 of the body 46 which urges the lever 63 in a counterclockwise direction into engagement with the inner end of the keys 8, 9 and 10, and thus, urge the keys in a clockwise direction for abutting engagement with the tabs 73, as previously described. The lever 63 includes a cam surface 63*a* which extends angularly upwardly and forwardly such that the inner end of one of the keys 8, 9 or 10 will cammingly slide upwardly therealong when it is actuated and cause rearward pivotal movement of the lever 63 in a clockwise direction.

Referring again to FIG. 1, the inlet valve assembly 47 includes a remote mounted solenoid-operated valve 92. The solenoid valve 92 has its inlet connected to the saddle clamp 88 via a conduit 91 and its outlet connected to the reservoir 4 (inlet) via a conduit 93. The reservoir outlet is connected to the common manifold passage 80 via a conduit 94. The valve 92 is actuated by a switch assembly 95 which may be mounted on the housing 3, such as on one sidewall 32, within a compartment 3*a* (FIG. 3) behind the back wall 90 so as to be separated from all of the plumbing of the inlet valve assembly 47. As best shown in FIG. 3, the switch assembly 95 includes a yieldable contact button 96 which is adapted to be depressed by an adjustable contact pin 97, such as a screw or the like, which is threadably mounted at one end of the lever 63. More particularly, and as best shown in FIG. 6, the back wall 90 includes an opening 98 to enable the pin 97 to contact the button 96. Still further, the pin 97 is adjustable to vary the distance which it projects rearwardly from the lever 63 so as to provide proper timing in opening and closing the valve assemblies 76, 77 and 78, and the solenoid valve 92. More particularly, the switch assembly 95 must be adjusted to energize the solenoid valve 92 after the valve assemblies 76, 77 and 78 have been mechanically opened to start dispensing and to de-energize the solenoid valve 92 before the valve assemblies 76, 77 and 78 have been closed to avoid the possibility of a pressure buildup which could result in leakage in the assembly 6.

The mixing section 20 (FIGS. 3 and 6) is detachably mounted on the body 46 and operates to mix the concentrate with water in a manner substantially similar to that described in the aforementioned U.S. Pat. No. 3,756,473. That is, venturitype mixing devices 100 and 101 are provided which include a pair of venturi tubes 103 and 103*a* which operate to draw the concentrate from the containers 15 and 15*a*. Variable orifice bypass controls 104 and 104*a* are operably connected to the tubes 103 and 103*a* for controlling the rate of flow of concentrate to water being dispensed such as by the knobs 22 and 23. The venturi tubes 103 and 103*a* are mounted in spaced-apart relation on a frame 105 which includes a rear support bar 105*a* and a front support plate 105*b*. The tubes 103 and 103*a* have their inner ends adapted for telescopic connection in outlet conduits or sockets 106 and 106*a* which are integrally formed in the support body 46 for connecting the tubes 103 and 103*a* in fluid communication with the outlets of the valves 76 and 78, respectively. The outer ends of the tubes 103 and 103*a* extend through the front plate 105*b* and are adapted for connection to the nozzles 12 and 14. In the form shown, the front plate 105*b* includes an opening 108 between the venturi tubes 103 and 103*a*. The support body 46 includes an integrally formed outlet conduit 109 for the center valve assembly 77 (FIG. 4) which projects forwardly beyond the sockets 106 and 106*a* and extends through the opening 108 when the mixing section is in the mounted position. The outer end of the conduit 109 remote from the body 46 projects beyond the front support plate 105*b*, being adapted for connection to the water dispensing nozzle 13. The nozzles 12, 13 and 14 are all provided with generally L-shaped slots, only two are shown at 110 and 111 in FIG. 6, adjacent one side for receiving projections 114, 115 and 116 which extend radially outwardly from the tube 103, conduit 109 and tube 103*a*, respectively. The nozzles 12, 13 and 14 each include a flange having a radially extending abutment (only one shown at. 117 in FIG. 2) abutting engagement with bosses, such as at 117*a*, on the front support plate 105*b*, for limiting the rotation of and properly positioning the nozzles 12, 13 and 14 in a downwardly or vertical dispensing position. By the foregoing arrangement, the entire mixing section 20 is locked in the assembled position when the water dispensing nozzle 13 is connected in the dispensing position to the conduit 109. In addition, each of the nozzles 12, 13 and 14 includes an air vent 12*a*, 12*b* (FIG. 6) and 12*c* (FIG. 2) for venting the interior of nozzles to prevent backup of beverages through the vent slot in the outlets of the venturi tubes 103 and 103*a*, such as are provided in the venturi tubes described in U.S. Pat. No. 3,756,473.

As shown in FIGS. 2 and 3, the containers 15 and 15*a* are mounted in the lower section 36 of the housing 3. An upright divider wall 119 is mounted on and extends upwardly from the bottom wall 29 for guiding the containers 15 and 15*a* into position in the housing 3. As best seen in FIG. 6, each container, such as 15, includes a lid 120 for sealing the container to lengthen the storage life and retain the flavor of the concentrate contained therein. The lid 120 also enables the stacking of a plurality of containers one upon the other when stored outside of the housing 3, to provide a variety of concentrate flavors for selective interchangeable use in the dispensing assembly. The containers 15 and 15*a* are detachably connected at their outer or front ends to the mixing section 20 in a manner substantially the same as described in U.S. Pat. No. 3,756,473. More particularly, and referring again to FIG. 6, each container, such as 15, includes a conduit 122 which is detachably and telescopically connected to a sleeve 123 on a check valve 124 which is connected to one of the venturi tubes, such as 103. The lid 120 and shelf 34 are formed with inwardly extending recesses 126 and 127, respectively, to provide clearance for the sleeve 123 to make connection with the conduit 122.

As shown in FIG. 3, the bottom wall 29 is inclined downwardly toward the front and of the housing 3 forming a ramp for slidably supporting the container 15 and 15*a* for installation andd removal from the housing 3. The containers, such as 15*a*, are placed on the bottom wall 29 and slid into the housing 3 until they engage the rear wall 29. The rear wall 29 is positioned so as to locate or align the conduit 122 directly under the sleeve 123. The bottom wall 29 is inclined to the extent that when the front side of the container 15*a* is lifted, the container 15*a* will pivot about its inner or rear side on the bottom wall 29 to connect the conduit 122 in the sleeve 123. The nozzles 12 and 14 each include latches 130 (FIG. 6) and 130*a* (FIG. 3) which are made integral therewith and which cammingly and interlockingly engage flanges 131 (FIG. 6) and 131*a* (FIG. 3) on the containers 15 and 15*a*, respectively, for holding the front sides of the containers above the bottom wall 29 while the rear side is supported on the bottom wall 29 when in the assembled position, as best seen in FIG. 3. The latches 130 and 130*a* are rotatable with the nozzles, such as over an angle of 45°, so as to be disengageable from the flanges 131 and 131*a* to release the containers 15 and 15*a* so that they may be lowered downwardly onto the bottom wall 29 when being removed. By this arrangement, there is considerably less likelihood of spilling of the concentrate by accidentally dropping or otherwide mishandling of the containers 15 and 15*a* as they are being removed from or installed in the housing 3.

Referring again to FIGS. 3 and 6, a drip tray 140 is mounted adjacent the front end of the housing 16 below the cover 26. More particularly, the drip tray 140 extends widthwise of the housing and includes an outer trough 141 and an inner trough 142. The inner trough 142 is formed with grooves along its opposed side edges as best seen, at 143 (FIG. 2), which are arranged to slidably receive oppositely disposed, mating tongues, such as at 144, in FIG. 2, which project inwardly from the sidewalls 32. A downwardly depending under wall 145 depends downwardly from the bottom wall 29 and extends between the sidewalls 31 and 32. The wall 145 is cut along its lower marginal edge, as at 149, to form an opening defined by a marginal cam edge 148. The drip tray 140 includes a deformable, resilient flange 146 which extends rearwardly from the inner trough 142 having a downwardly and rearwardly inclined cam surface 147 for camming coacting engagement with the cam edge 148 to deform the flange downwardly and a downwardly and forwardly inclined surface 147*a* which enable the flange to return toward its undeformed condition and engages the edge 148, to interlock the flange 146 in snap action relation with the under wall 145 for securing the drip tray 140 to the base when in its fully inserted position, as in FIG. 3. Further, the outer trough 141 is disposed outwardly of the cover 26 and beneath the nozzles 12, 13 and 14 to receive any material dripping therefrom, whereas, the inner trough 142 is disposed on the opposite side of the cover 26 interior of the housing 3 and beneath the mixing section to receive material which may for any reason be leaking or dripping therefrom. By this arrangement, the drip tray 140 is easily and readily removable from the housing 3 independently of the cover 26 for cleaning when dripping or leakage does occur contributing to the maintenance of a sanitary condition within the refrigerator.

I claim:

1. A drink dispenser assembly for dispensing one of a plurality of beverages consisting of water or a mixture of water and a drink concentrate comprising:

a reservoir means for supplying water in said assembly;

a support adapted for mounting in a refrigerator.

a selector valve means mounted on said support for controlling the flow of water in said assembly;

said selector valve means includes a plurality of distributing valve assemblies, each having a closed position preventing water flow therethrough and an open position permitting water flow through its outlet;

nozzle means connected to said distributing valves for dispensing said beverages;

said selector valve means includes a plurality of laterally extending selector keys disposed in juxtaposed relation for easy beverage identification and selection;

said keys are supported by said support for pivotal movement in generally parallel planes each having one end operably connected to a respective one of said valve assemblies for moving the latter between its closed and open position to permit water to flow to said nozzle means for dispensing therefrom;

container means on said support for storing a drink concentrate therein;

mixing means connected between said container means and the outlet of at least one of said valve assemblies for mixing a concentrate with said water; and said nozzle means includes one nozzle connected to said mixing means and said outlet of said one valve assembly for dispensing a mixture of water and a concentrate therefrom upon actuation of its associated key;

and including inlet valve means having a main inlet valve, and a common operating lever is supported by said support for camming engagement with said one end of each of said keys for actuating said inlet valve to permit water to flow through to said distributing valve assemblies.

2. A dispenser assembly in accordance with claim 1 wherein said inlet valve comprises a solenoid-actuated valve mounted in said refrigerator at a location remote from said housing, a switch assembly is mounted on said housing separated from said valve assemblies, and said common operating lever is supported for pivotal movement into contact engagement with said switch assembly to energize and de-energize said solenoidactuated valve.

3. A dispenser assembly in accordance with claim 1 wherein said support comprises a housing having an opening at one end, the other end of said keys are accessible through said opening for actuating said keys, said housing includes rail means defining an upper section for said housing, said selector valve means includes a body having rail follower means for guiding said body into and out of said housing for easy assembly and disassembly thereof, and resilient retaining means coacting between said body and said housing for retaining said selector valve means in the assembled position within said housing.

4. A dispenser assembly in accordance with claim 1 wherein said support comprises a housing having an opening at one end, the other end of said keys are accessible through said opening for actuating said keys, said container means includes at least one container having one end adapted for detachable connection to said mixing means, said housing including ramp means below said mixing means for slidably guiding said container into and out of said housing, and the opposite end of said container is pivotally supported by said ramp means to enable said one end of said container to be raised from said ramp means into its connected position and lowered onto said ramp means upon disconnection thereof to reduce the possibility of spillage of said concentrate from said container during assembly and disassembly thereof.

5. A dispenser assembly in accordance with claim 1 wherein said support comprises a housing having an opening at one end, the other end of said keys are accessible through said opening for actuating said keys, said housing includes window means for observing the level of said concentrate in said container means and said housing includes abutment means on said ramp means for limiting movement of said container along said ramp means for aligning one end of said container with said mixing means for connection thereto.

6. A dispenser assembly in accordance with claim 1 wherein said selector valve assembly means includes a body, said mixing means is mounted on said body, said mixing means includes a frame having an opening therein, said body includes an outwardly projecting conduit connected in fluid communication at one end to another one of said valve assemblies, said conduit extends through the opening having an outer end projecting beyond said frame when said mixing means is in the mounted position on said body, and said nozzle means includes one nozzle detachably and interlockingly connected to the outer end of said conduit for securing said mixing means in the mounted position on said body.

7. A dispenser assembly in accordance with claim 1 wherein said support comprises a housing, said housing includes a removable cover disposed in covering relation over said nozzle means and is removable to provide access to the interior or said housing, a drip tray is detachably connected to said housing below said nozzle means, and said drip tray is detachable from said housing independently of said cover.

8. A dispenser assembly in accordance with claim 7 wherein said drip tray is of a double trough construction including an outer trough disposed outwardly of the housing below said nozzle means for receiving any dripping material outwardly of said housing and an inner trough disposed inwardly of said housing for receiving dripping material interiorly of said housing.

* * * * *

UNITED STATES PATENT OFFICE

CERTIFICATE OF CORRECTION

Patent No. 3,942,685 Dated March 9, 1976

Inventor(s) Marvin T. Lindner

It is certified that error appears in the above-identified patent and that said Letters Patent are hereby corrected as shown below:

Column 1, line 47, "are", first occurrence, should read -- and --. line 48, "houring" should read -- housing --.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*